United States Patent [19]

Goss et al.

[11] 4,100,961

[45] Jul. 18, 1978

[54] FOUNDRY MOLDING MACHINE

[75] Inventors: Harold R. Goss, Richmond Heights; Michael A. Krutilla, Chagrin Falls, both of Ohio; Wendell M. Doolin, Bloomfield Hills, Mich.

[73] Assignee: Acme-Cleveland Corporation, Cleveland, Ohio

[21] Appl. No.: 742,860

[22] Filed: Nov. 18, 1976

[51] Int. Cl.[2] ..... B22C 13/12; B22C 15/24; B22C 17/02

[52] U.S. Cl. ..... 164/180; 164/186; 164/188; 164/201; 164/213; 164/226

[58] Field of Search ..... 164/180, 186, 181, 190, 164/191, 213, 218, 222, 228, 200, 201, 207, 226, 227, 404

[56] References Cited

U.S. PATENT DOCUMENTS

| | | | |
|---|---|---|---|
| 2,669,759 | 2/1954 | Volyi | 164/226 |
| 3,096,547 | 7/1963 | Hunter et al. | 164/226 X |
| 3,482,619 | 12/1969 | Hulslander | 164/186 X |
| 3,528,481 | 9/1970 | Lund | 164/200 X |
| 3,556,195 | 1/1971 | Lund | 164/201 X |
| 3,760,866 | 9/1973 | Larkin | 164/213 X |
| 3,994,333 | 11/1976 | Linneweb et al. | 164/186 X |

FOREIGN PATENT DOCUMENTS

| | | | |
|---|---|---|---|
| 1,915,615 | 10/1970 | Fed. Rep. of Germany | 164/186 |
| 47-14270 | 4/1972 | Japan | 164/226 |
| 441,091 | 11/1969 | U.S.S.R. | 164/186 |

*Primary Examiner*—Francis S. Husar
*Assistant Examiner*—John S. Brown
*Attorney, Agent, or Firm*—Woodling, Krost, Granger & Rust

[57] ABSTRACT

A foundry molding machine is disclosed wherein a core or mold is molded from moldable material such as sand in first and second mold boxes having a cavity. The cavity is filled with the sand and is then cured to form the mold. The first and second mold boxes are separated so that the mold remains in the first mold box with a downwardly facing cavity. Any of several means may be used to assure that the mold remains in this downwardly facing cavity. A transfer conveyor is then moved to a position closely beneath the mold. The first mold box is then moved upwardly as ejection means acts on the mold to eject it downwardly onto the closely spaced transfer conveyor. The transfer conveyor then moves out from underneath the first mold box to remove the completed mold and the cycle repeats. The foregoing abstract is merely a resume of one general application, is not a complete discussion of all principles of operation or applications, and is not to be construed as a limitation on the scope of the claimed subject matter.

16 Claims, 6 Drawing Figures

FOUNDRY MOLDING MACHINE

BACKGROUND OF THE INVENTION

Foundry molding machines have been utilized to make both cores and molds. In one prior art type of foundry molding machine, the core or mold is made in the cavity of two mold boxes and then the core or mold, hereinafter called a mold, is held in one of the mold boxes which swings so that the cavity faces downwardly. An ejection plate with ejection pins is then actuated downwardly to eject the mold downwardly out of the cavity onto some transfer device.

In another type of prior art foundry molding machine the mold produced in the mold cavity of the two mold boxes is retained in the upwardly facing cavity as the mold boxes are separated. Subsequently an ejector plate and ejector pins are moved upwardly to move the mold up out of the cavity to a position sufficiently elevated so that a fork may be moved in transversely with the tines of the fork between the ejector pins. Then the pins are lowered to transfer the mold onto the fork and the fork then retracts laterally.

In both of these types of machine the mold is caused to be moved by the ejection means and this movement relative to the cavity in which it had previously been located often causes breakage of the mold. The machines of the first type, namely the downward ejection of the core or mold out of the downwardly facing cavity, was generally restricted in use to rather robust molds which could drop onto their receiving conveyor without breaking. It was also used primarily for smaller mold items. In one prior art production machine of the second type mentioned above, namely the upward ejection of the mold, a particularly delicate mold was being produced which was long and thin with many areas of thin cross-sectional area. A production rate of 70 to 75 percent, with a scrap rate of 25 to 30 percent in production of the molds, was about the best that could be produced hence was considered acceptable.

The problem to be solved accordingly is how to manufacture in high production quantities fragile or delicate mold without having a large scrap rate.

SUMMARY OF THE INVENTION

The invention may be incorporated in a foundry machine, comprising, in combination, a frame, first and second mold boxes mounted in said frame for mutual cooperation defining a mold cavity for a mold, means to invest mold material into said mold cavity, curing means to at least partially cure mold material in said mold cavity to form a mold, ejection means mounted in the machine and cooperable with said first mold box in a position above said first mold box, motive means connected to relatively move said mold boxes and connected to move said first mold box relative to said ejection means, transfer means, power means to relatively move said transfer means and said first mold box to an ejection position with said transfer means beneath said first mold box and mold therein, and control means connected to provide a sequence of operation to actuate said motive means to close said mold boxes and invest mold material into said mold cavity and at least partially cure a mold in said mold cavity, to actuate said motive means to separate said mold boxes, to actuate said power means to relatively move said transfer means and said first mold box to said ejection position, to actuate said motive means to lift said first mold box to eject the mold by said ejection means onto said transfer means, and to actuate said power means to transfer the mold away from said first mold box.

Accordingly an object of the invention is to provide a machine which will carefully eject fragile cores or molds.

Another object of the invention is to provide a foundry molding machine wherein downward ejection of a core or mold is provided by the lifting of the mold box in which the mold is disposed.

Another object of the invention is to provide a foundry molding machine wherein the core or mold may be held stationary in space during ejection from the mold cavity.

Other objects and a fuller understanding of the invention may be had by referring to the following description and claims, taken in conjunction with the accompanying drawing.

DESCRIPTION OF THE PREFERRED EMBODIMENT

Figure 1:
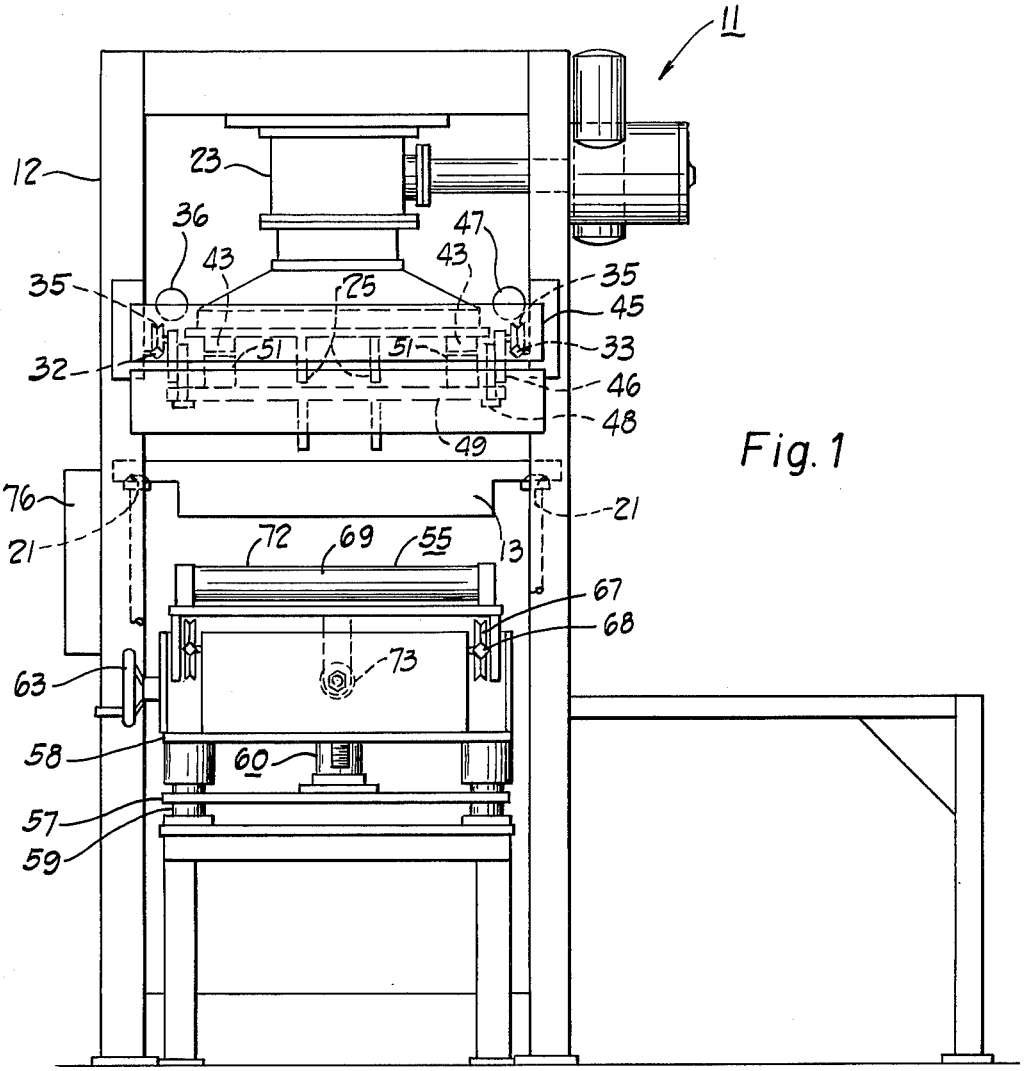
FIG. 1 is an end view of a foundry molding machine incorporating the invention.

The figures of the drawing illustrate a foundry molding machine 11 incorporating the invention. The machine 11 includes a frame 12 which may include four vertical columns. A first mold box 13 and a second mold box 14 are mounted in the frame for mutual cooperation. A first and second cavity 15 and 16, respectively, are provided in the mold boxes 13 and 14 to define a cavity for mold material such as sand and a binder, hereinafter referred to as sand. The sand is adapted to be invested into the cavity 15, 16 to form a core or mold item. Since this machine 11 is designed to produce very fragile mold items, they may more often be cores rather than strictly be molds, but for convenience in referring to these core or mold items, they will hereinafter be referred to simply as molds 17.

Figure 2:
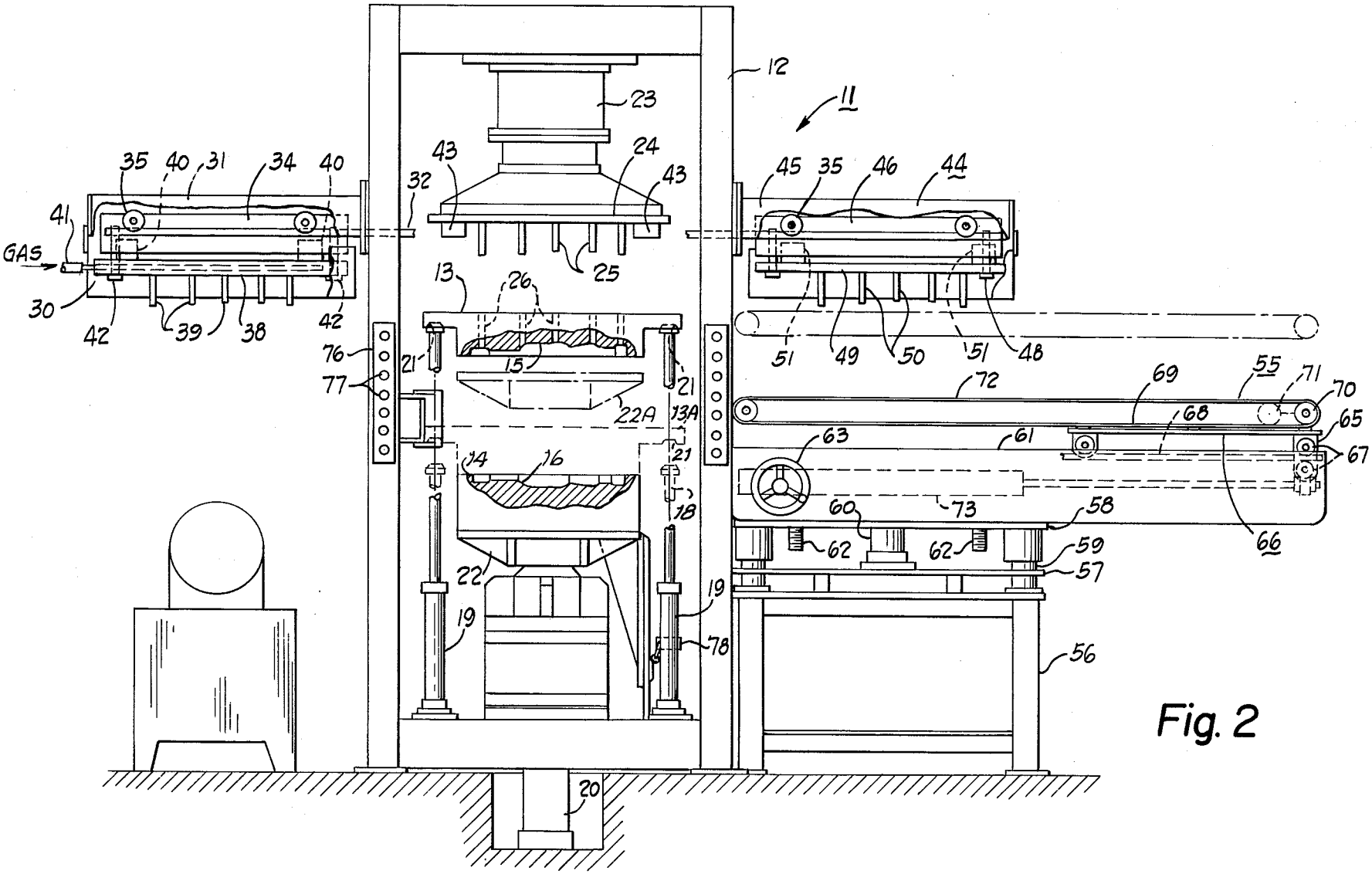
FIG. 2 is a front view of the machine.

Motive means is provided to open and close the mold boxes 13 and 14. This motive means includes a first motive means 19 constructed and arranged to actuate the first mold box 13 in a vertical path. Also second motive means 20 is provided to move the second mold box 14 in a vertical path. The first motive means may be a plurality of hydraulic cylinders such as four cylinders having piston rods 18 which may engage the four corners of the first mold box 13 at sockets 21, although not being physically attached to this first mold box 13. This provides a lost motion connection. The second motive means may be a hydraulic cylinder connected to move a table 22 with the second mold box 14 secured on the top of this table 22. The table 22 may have a long vertical stroke, for example, to move the table to a position **22*a* as shown in FIG. 2**.

Investment means is provided in the machine 11 to invest mold material or sand into the cavity 15, 16. This investment means may take the form of a blow head 23 to blow sand downwardly from a sand hopper, not shown, into the cavity 15, 16. A blow plate 24 is secured to the underside of the blow head 23 and contains one or more blow tubes 25. The first mold box 13 includes a plurality of apertures 26 vertically aligned with the blow tubes 25. The first motive means 20 may be actuated to move the second mold box 14 upwardly. It will book or close with the first mold box 13 and lift this first mold box 13 off the piston rods 18 of cylinders 19. Continued movement of the first motive means 20 upwardly will cause the first mold box 13 to move up until it strikes the blow plate 24 and the blow tubes 25 are then inserted into the apertures 26. In this position the blow head 23 may be actuated to invest sand into the cavity 15, 16.

After sand has been invested into the cavity, curing means may be utilized to cure the sand in this cavity. This curing means may take the form of heat of a thermally setting binder in the sand, or as shown, may take the form of a cold curing. A gassing head 30 may provide a curing gas flow through the mold material to cure it into the mold 17. The curing head 30 is supported in a fixed U-shaped frame extension 31 which supports a horizontal rail 32 at the front of the machine 11 and a similar rail 33 at the rear of the machine. A movable U-shaped carriage 34 journals wheels 35 which ride on the rails 32, 33. This permits reciprocation of the curing head 30 as moved by a motor 36 between a first position shown in FIG. 2 outboard of the frame 12 to a central position beneath the blow head 23. The curing head 30 includes a gassing plate 38.

The carriage 34 has fixed to it depending posts 42 for example four posts, one in each corner, to slidingly support the gassing plate 38 for slight vertical movement. The gassing plate 38 is in the form of a manifold having gas tubes 39 depending from this plate and blocks 40 extending upwardly from the top of the plate. These blocks are positioned on the outer edges of the plate so as to straddle the blow tubes 25 when the curing head 30 is moved to the central position. The blocks 40 are adapted to strike abutment blocks 43 when the curing head 30 is raised in the central position. A curing gas may be supplied at an inlet 41 into the manifold and down through the gas tubes 39 to cure the sand when the curing head 30 is in the central position and the mold boxes 13 and 14 are pressed up against this curing head 30, resisted by the blocks 40 engaging the abutment blocks 43.

Figure 3:
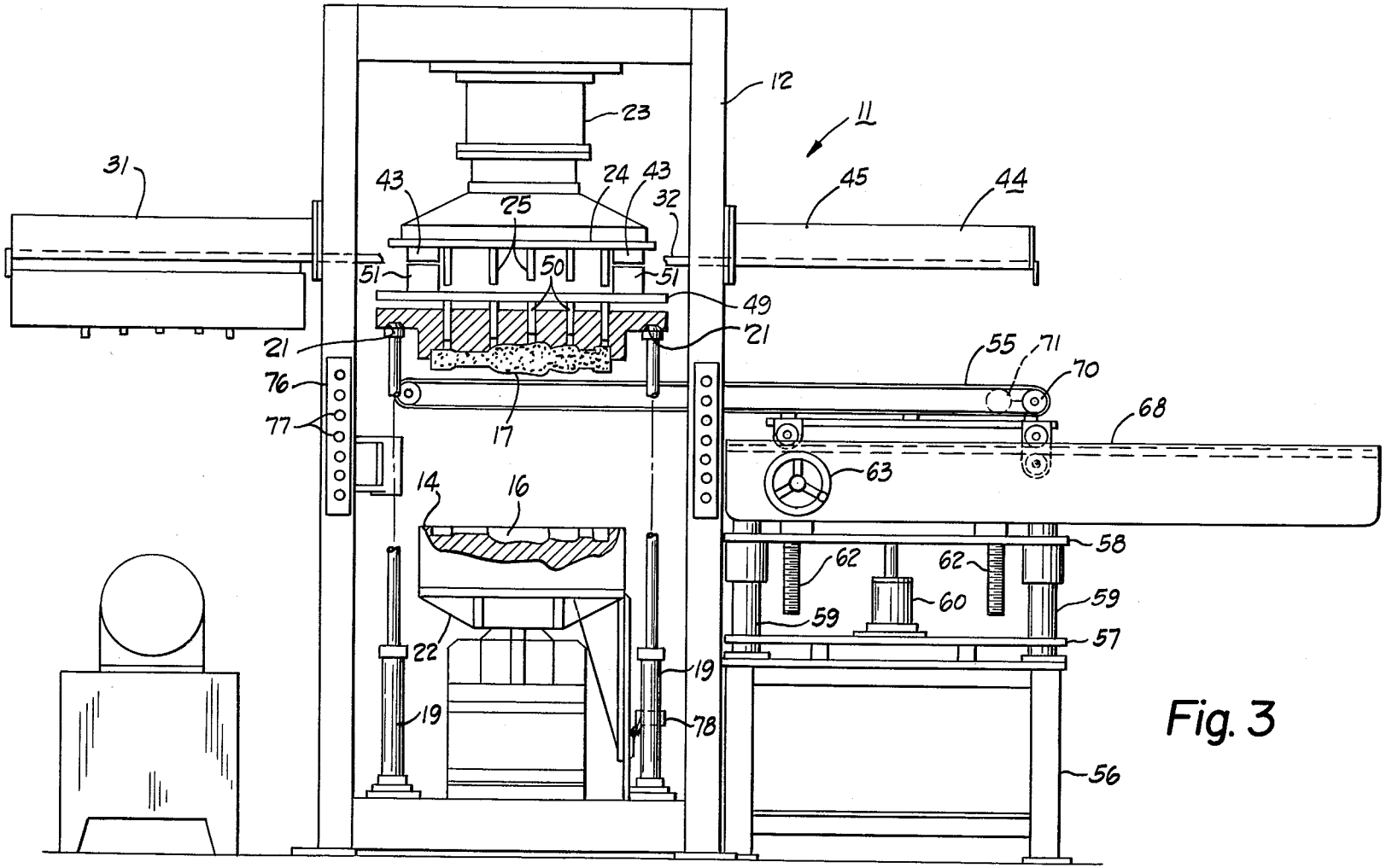
FIG. 3 is another front view showing the machine components at a different position.

Ejection means 44 is provided in the machine 11 to eject the mold 17 from the cavity 15, 16. This ejection means is mounted on the side of the frame 12 opposite to the curing head 30 and has a similar mounting construction. The ejection means 44 includes a fixed U-shaped frame extension 45 fixed on the frame 12 which fixedly mounts the rails 32 and 33 at the front and rear of the frame 12. A movable U-shaped carriage 46 journals wheels 35 which ride on the rails 32 and 33 to permit movement of this carriage 46. The carriage 46 may move between a position outboard of the frame 12, as shown in FIG. 2 to a central position beneath the blow head 23, as shown in FIG. 3. This carriage 46 may be moved by a motor 47. A plurality of posts such as four posts 48 depend from the movable carriage 46 and support an ejection plate 49, which has depending ejection pins 50. These pins 50 may be received in one or more of the apertures 26 in the first mold box 13. These pins 50 are spaced to register with selected ones or all of such apertures 26 when the ejection plate 49 is in the central position. The ejection plate 49 carries blocks 51, cooperable with the abutment blocks 43, and which are disposed near the edges of the plate 49 to straddle the blow tubes 25 when the ejection plate 49 is in the central position.

The motive means 19 and 20 provide relative movement between the first and second mold boxes 13 and 14 and also provide relative movement between the closed mold boxes and the blow head 23, provide relative movement between the closed mold boxes and the curing head 30, and provide relative movement between the first mold box 13 and the ejection means 44.

Transfer means 55 is provided to transfer the mold 17 away from the first mold box 13. This transfer means 55 includes a frame extension 56 on which a lower plate 57 is mounted. A middle plate 58 is movably mounted for vertical movement by guides 59 and power means 60 such as a hydraulic cylinder is provided for powered vertical movement of the middle plate 58. An upper plate 61 is mounted for movement in a vertical path on the middle plate 58 as actuated by screws 62 moved by a hand wheel 63. This hand wheel provides a range of adjustment in a vertical direction of the transfer means 55 depending on the size of the mold boxes and mold, and then during the automatic cycle of operation the power means 60 provides powered vertical movement.

The transfer means 55 includes conveyor means 65 including a carriage 66 having wheels 67 riding on rails 68 on the upper plate 61. A conveyor belt 69 runs on rollers 70 in a movement powered by a motor 71. The conveyor belt 69 has an upper run 72 onto which the mold 17 may be ejected. The carriage 66 is powered in horizontal reciprocating motion by power means 73 such as a fluid cylinder.

Figure 6:
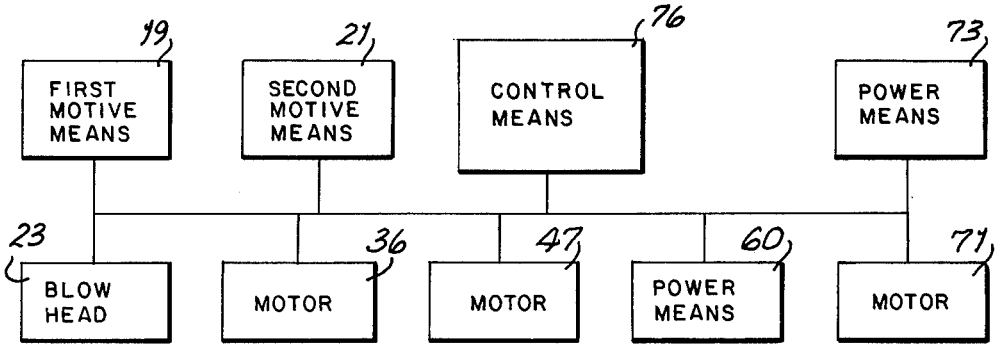
FIGS. 4 and 5 are partial views showing the machine components in still further stages of producing a mold and FIG. 6 is a block diagram of the control means.

Control means 76 shown in FIGS. 2 and 6 is provided to control an automatic cycle of actuation and this control means 76 includes control push button switches 77 as well as limit switches 78 mounted for actuation by movement of the various machine components.

These components include the motive means 19 and 20, blow head 23, motors 36, 47 and 71, and the power means 60 and 73.

OPERATION

The foundry molding machine 11 is designed to produce cores or molds in high production and with a minimum amount of scrap. Specifically long, thin or otherwise fragile cores or molds may be readily produced due to the novel manner in which the molds are ejected by the ejection means 44.

The cycle of operation may be described starting at most any point in the cycle since it is a repetitive cycle of operation. The first motive means 19 may be controlled to lower the piston rods 18, as shown in phantom in FIG. 2, so that these piston rods 18 are separated from the sockets 21, providing the above-mentioned lost motion connection. Starting with the machine in the position shown in FIG. 2, it will be noted that the second mold box 14 is in the down-most position of the second motive means 20, and the first motive means 19 is raised completely so that the first mold box 13 is supported at the sockets 21. The curing head 30 is extended to one side of the frame and the ejection means 44 is extended to the opposite of the frame 12. Assuming that the cycle starts at this position, the second motive means 20 is controlled by the control means 76 so that it moves upwardly causing the second or lower mold box 14 to book or close upon the first or upper mold box 13.

The second motive means 20 continues in its upward movement thereby lifting the first mold box 13 off the piston rods 18 of the first motive means 19. The continued upward movement causes the first mold box 13 to engage the blow plate 24 between the abutment blocks 43 which are outboard of the area of the blow tubes 25. These blow tubes extend into a plurality of the apertures 26 in the first mold box 13. Investment of the cavity 15, 16 may then take place in a manner well known in the art, for example by air pressure applied on the sand to force it from the blow head 23 through the blow tubes 25 into the cavity. Upon completion of filling the cavity, the blow cycle is completed and the second motive means 20 retracts downwardly to move the first and second mold boxes 13 and 14 downwardly as a unit to a position whereat the first mold box 13 does not quite engage the extended piston rods 18 of the first motive means 19. This leaves a clearance between the blow plate 24 and the top of the first mold box 13. Next the curing head 30 moves from the first position shown in FIG. 3 to the central position by the motor 36. The second motive means 20 is again actuated to move the booked first and second mold boxes upwardly squeezing the curing head 30 between the first mold box 13 and the blow plate 24. Actually the blocks 40 engage the abutment blocks 43 for proper spacing and to resist the upward force of the second motive means 20. A curing gas such as a catalyst to cure the binder in the sand is next introduced at the gas inlet 41 to the gassing plate manifold 38 and it passes through the gas tubes 39 to cure the binder in the sand within the cavity. This gassing is continued until the mold material is cured into the mold 17 and then the remaining gas may be purged from the manifold 38 and the cavity 15, 16. Next the second motive means 20 is moved downwardly to move the first mold box 13 down until the sockets 21 nearly engage the extended piston rods 18 of the first motive means 19. The curing head next is moved by the motor 36 to its outward position as shown in FIG. 3.

The ejection means 44 next is used. The motor 47 moves the ejection plate 49 from the outboard position shown in FIG. 2 to the central position shown in FIG. 3. In this position the blocks 51 are spaced only slightly below the abutment blocks 43. Next the first motive means 19 is actuated until the piston rods 18 take up the lost motion to engage the sockets 21 in the first mold box and lift the first mold box off the second mold box 14. The mold 17 is retained within the first mold box 13 by any suitable means which may include:

A. Less draft on the first mold box 13 than in the second mold box 14;

B. A keeper of some kind in the first mold box 13 acting on the mold 17;

C. A loose piece in the first mold box 13 which must be withdrawn transversely before the mold 17 may be ejected; or D. Positive ejection pins acting upwardly in the second mold box 14.

In many cases the shape of the cavities 15 and 16 can be proportioned to make certain that the mold 17 is retained in the upper or first mold box 13.

The first motive means 19 continues its upward movement to what may be termed a pre-ejection position whereat the ejection pins enter a selected plurality of the apertures 26 in the first mold box 13 to a point whereat the ends of the pins 50 almost engage the mold 17. The second motive means 20 is actuated to move the table 22 downwardly out of the way and the transfer means 55 is actuated to move the conveyor 65 inwardly and upwardly. The inward and upward movement of this conveyor assures that the cantilevered end of the conveyor belt will be in the central position beneath the mold 17 and the upward movement assures that the upper run 72 of the conveyor belt 69 will be closely adjacent the bottom of the mold 17. It may be made to touch the bottom of this mold 17 if desired, especially where the conveyor belt is somewhat resiliently supported. This will be the position of the machine as shown in FIG. 3.

Figure 4:
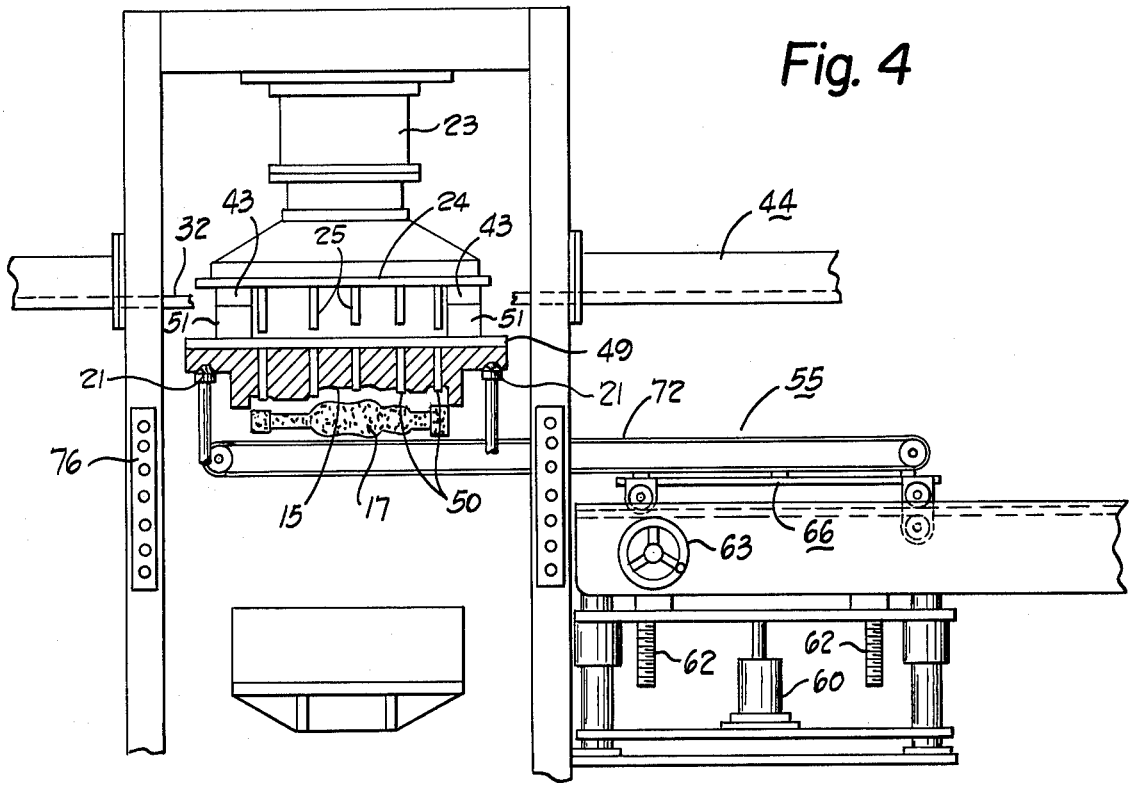

The actual ejection of the mold 17 takes place in a novel manner by maintaining the mold 17 stationary in space and lifting the first mold box 13 upwardly off this mold 17. This is effected by the movement of the first motive means 19 being actuated upwardly to move the first mold box 13 upwardly and this means that with the ejection pins 50 stationary in space they act on the mold 17 to hold the mold substantially stationary in space and thus the ejection of this mold is caused by the upward movement of the first mold box 13 away from this mold 17. Should the mold 17 be one which is difficult to remove from the cavity 15, then the ejection pins 50 may move upwardly which causes the ejection plate 49 to move upwardly sliding on the posts 48 until the blocks 51 engage the abutment blocks 43. This provides a positive abutment to assure positive ejection of the core 17. This ejected core or mold 17 will then be as shown in FIG. 4. Due to the very close proximity of the conveyor belt upper run 72, the mold 17 need not drop any appreciable distance perhaps only about one centimeter and thus even very fragile cores are carefully ejected for a minimum of breakage.

This machine 11 has been used to produce molds 17 which are quite delicate. The mold produced was actually a core for the water jacket of the cylinder head of a six cylinder automative engine. This core was about 75 centimeters long, ten to 15 centimeters wide, and a thickness of only one to two centimeters in many places along it length. Accordingly it was a very fragile core and when produced by the prior art machines a production rate of 70 to 75 percent was about the best that could be produced and hence was considered acceptable. The present machine 11 has been able to considerably better this rate of production.

Figure 5:
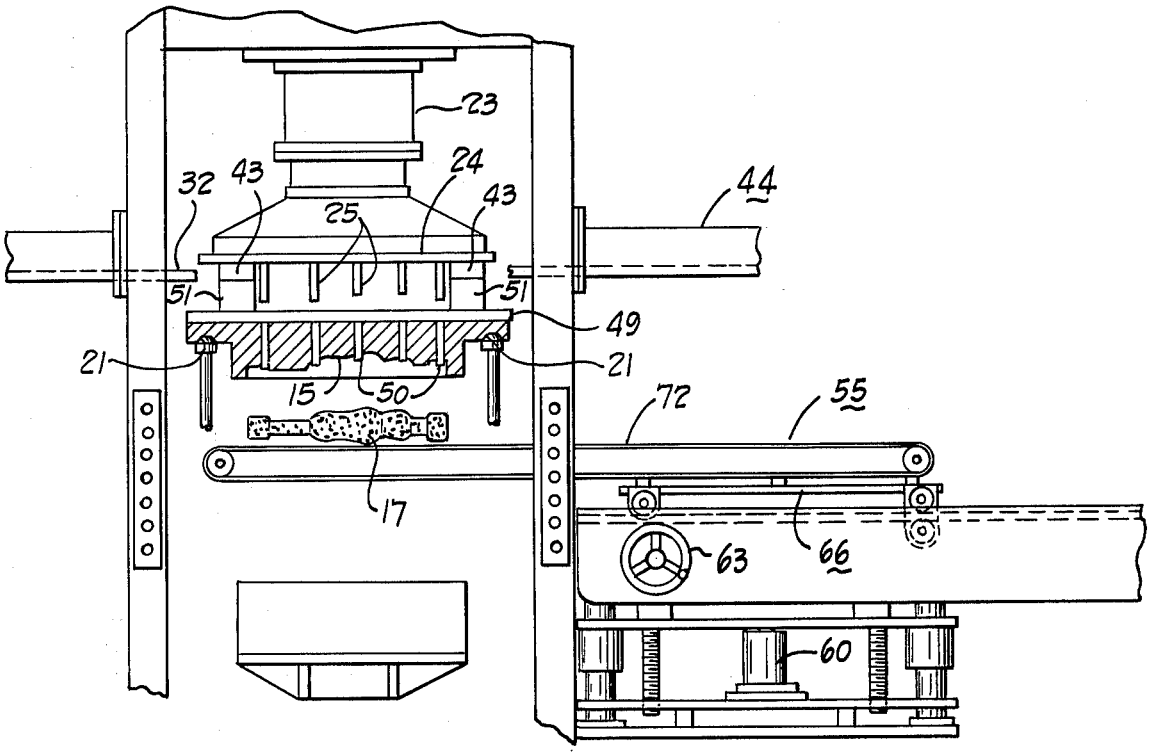

Next the power means 60 is actuated to lower the conveyor belt 69 to the position shown in FIG. 5. This is a lowering sufficient that the top of the mold 17 will clear the bottom surface of the first mold box 13. The transfer means 55 may then be actuated, for example, by actuation of the power means 73 and the motor 71. Motor 73 retracts the entire conveyor 65 from under the first mold box 13 and the motor 71 moves the conveyor belt upper run 72 to move the mold 17 to a position near the outboard end of the conveyor 65, and then the motor 71 is deactuated. At this point the mold 17 may be transferred by any desired means to further manufacturing processes.

The automatic cycle of operation may be considered complete at this point, although two more steps are necessary to return the machine to the starting point as described above. The first motive means 19 is next actuated downwardly to move the first mold box 13 downwardly off the ejection pins 50. Secondly, the ejection plate 49 is moved from the central position of FIG. 3 to the outboard position of FIG. 2. Thus the machine 11 will then be in the position shown in FIG. 2 ready to start another cycle.

The curing head 30 and the ejection plate 49 are shown in FIG. 2 as extending on opposite sides of the frame 12. This is an advantageous position in which to have these machine components so that they may be readily cleaned, if necessary, between machine cycles.

The machine 11 has considerable advantages in productivity over the prior machine molding this same automotive water jacket mold or core 17. In such prior machine the mold 17 was ejected upwardly from the second or lower mold box 14 by long ejection pins contained in this mold box 14. Next a fork type of transfer device was moved horizontally inwardly from the side so that the tines of the fork passed between the ejection pins. Next the ejection pins were lowered to transfer the core or mold onto the fork and the fork then moved horizontally out of the machine. This is the type of machine which had only about a 70 or 75 percent productivity, the remaining 25 to 30 percent of the molds produced being scrap due to breakage of one type or another. The reason for this high scrap rate was the lack of ability to provide careful handling of the core or mold during ejection and transfer. To obtain proper ejection all ejection pins must move at the same velocity and even acceleration and must move in synchronism. Because of the necessity of placing the ejection pins in rows which are spaced apart sufficiently far that the tines of the removal fork may enter between the rows, meant that the mold maker was not free to place the ejection pins in the best location for ejection. He was forced to put the pins in rows, e.g. every 10 centimeters apart, to accommodate fork tines spaced ten centimeters apart. Molds or cores take many different shapes and to require the ejection pins to be placed only in rows every ten centimeters apart may definitely not be the best position for careful ejection of this mold.

Another disadvantage with the upward ejection of the prior art machine was that one was attempting not only to move the mold upwardly out of the lower cavity but it was also attempting to break loose the mold from this cavity wall at the same time. One part of the mold might break loose from its adjacent cavity wall slightly before another part of the mold broke loose. This happens so quickly that it was difficult to analyze just what caused the breakage, but this attempt at upward movement of the mold out of the lower cavity was just unsatisfactory for high production rates without breakage. The present system of maintaining the mold substantially stationary in space and moving the first or upper mold box 13 upwardly away from the mold 17 has shown to be definitely superior in the ability to obtain a minimum scrap loss.

Another advantage of the present machine over the prior upward ejection machine was the the various molds produced may be many small molds. The machine 11 in one embodiment had a mold box area of approximately 100 centimeters square. In the old machine with a transfer fork having tines about every ten centimeters, and the ejection pins in the lower mold box necessarily spaced every 10 centimeters in rows, this meant that small cores or molds less than about 20 centimeters in size could not be produced otherwise they would fall through the tines of the fork. With this present downward ejection machine even much tinier molds may be produced.

Still another advantage is that the effective area of the mold boxes may be much better utilized by about 30 percent greater utilization. This is brought about by the fact that the ejection pins can be placed in the best location, not in rows and hence the entire 100 centimeter square area of the mold boxes may be utilized as an active surface on which the cavities may be located. Previously with upward ejection, the placement of the cavities on this working surface had to be carefully considered in view of the tines of the transfer fork.

Still another advantage of the present invention is that one often may eliminate entirely any upward ejection pins in the lower mold box 14. This can save tooling costs in the production of the mold boxes 13 and 14.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

We claim:

1. A foundry machine, comprising, in combination, a frame, first and second mold boxes mounted in said frame for mutual cooperation defining a mold cavity for a mold, means on said frame to invest mold material into said mold cavity, curing means on said frame to at least partially cure mold material in said mold cavity to form a mold, ejection means mounted in the machine and cooperable with said first mold box in a position above said first mold box, motive means mounted on said frame and connected to relatively move said mold boxes and connected to move said first mold box relative to said ejection means, transfer means mounted on said frame, power means connected to one of said transfer means and said first mold box to relatively move said transfer means and said first mold box to an ejection position with said transfer means beneath said first mold box and mold therein, and control means connected to provide a sequence of operation to actuate said motive means to close said mold boxes and invest mold material into said mold cavity and at least partially cure a mold in said mold cavity, to actuate said motive means to separate said mold boxes, to actuate said power means to relatively move said transfer means and said first mold box to said ejection position, to actuate said motive means to lift said first mold box to eject the mold by said ejection means onto said transfer means and to actuate said power means to transfer the mold away from said first mold box.

2. A machine as set forth in claim 1, wherein said ejection means includes means cooperating with said frame to maintain the mold stationary in space as said first mold box is lifted by said motive means to eject the mold onto said transfer means.

3. A machine as set forth in claim 1, wherein said motive means includes first means to move said first mold box and second means to move said second mold box.

4. A machine as set forth in claim 3, wherein said investment means includes motion of both said first and second mold boxes by said second means of said motive means.

5. A machine as set forth in claim 3, including a lost motion connection between said first means of said motive means and said first mold box to permit separate actuation of said first mold box by said second means of said motive means.

6. A machine as set forth in claim 1, wherein said ejection means includes an ejection plate movable transversely relative to said frame to a position over said first mold box.

7. A machine as set forth in claim 6, including ejection pins mounted on said ejection plate to cooperate with any mold in said cavity.

8. A machine as set forth in claim 6, wherein said motive means includes first means to move said first mold box and second means to move said second mold box, including a blow head as part of said investment means, and said second means of said motive means being connected to move said first and second mold boxes upwardly to squeeze said ejection plate between said first mold box and said blow head.

9. A machine as set forth in claim 1, wherein said curing means is mounted to move laterally relative to said frame to a position over said first mold box.

10. A machine as set forth in claim 9, wherein said curing means includes a gassing head constructed to pass a curing gas through the mold material in said mold cavity.

11. A machine as set forth in claim 1, including a rail mounted on said frame, and means mounting both said ejection means and said curing means on said rail.

12. A machine as set forth in claim 11, including mounting said ejection means for movement on said rail from a central position to an outboard position on one side of said frame, and mounting said curing means for movement on said rail from said central position to an outboard position on the opposite side of said frame.

13. A machine as set forth in claim 1, wherein said transfer means includes a belt conveyor having a movable belt run, and said ejection means ejects a mold onto said movable belt run.

14. A machine as set forth in claim 13, including rollers on which said belt run is movable, motor means operatively connected to said belt run to move said belt run on said rollers, and said control means actuating said motor means to move said belt run to transfer the mold away from said first mold box.

15. A machine as set forth in claim 1, wherein said power means is connected to move said transfer means in a path which includes both a horizontal component to a position beneath said first mold box and a vertical component to a position closely spaced below any mold in said first mold box.

16. A machine as set forth in claim 15, wherein said control means is connected to actuate said power means to lower the mold away from said first mold box and subsequently to move the mold in a path having a horizontal component to move the mold out from underneath said first mold box.

* * * * *